United States Patent [19]

Ihara

[11] Patent Number: 5,060,566

[45] Date of Patent: Oct. 29, 1991

[54] PRESS APPARATUS

[75] Inventor: Ryoseki Ihara, Aichi, Japan

[73] Assignee: Kabushiki Kaisha Ihara Kogyo, Aichi, Japan

[21] Appl. No.: 520,660

[22] Filed: May 10, 1990

[30] Foreign Application Priority Data

May 11, 1989 [JP] Japan ..... 1-117817
Jan. 12, 1990 [JP] Japan ..... 2-5878

[51] Int. Cl.[5] ..... B30B 1/16

[52] U.S. Cl. ..... 100/272; 72/450; 72/453.01; 100/281

[58] Field of Search ..... 100/270–272, 100/280, 281; 72/450, 453.01, 453.03, 456

[56] References Cited

U.S. PATENT DOCUMENTS

| | | | |
|---|---|---|---|
| 2,261,576 | 11/1941 | Wood | 100/280 X |
| 2,298,852 | 10/1942 | Ward | 100/272 X |
| 2,443,573 | 6/1948 | Brundage | 100/271 X |
| 3,472,057 | 10/1969 | Persico et al. | 72/456 X |
| 4,329,865 | 5/1982 | Meinholdt | 72/453.03 X |

FOREIGN PATENT DOCUMENTS

| | | | |
|---|---|---|---|
| 482226 | 4/1952 | Canada | 100/272 |
| 3868 | 9/1979 | European Pat. Off. | 72/450 |
| 693892 | 11/1930 | France | 100/271 |
| 993635 | 6/1955 | France | 100/281 |
| 935456 | 8/1963 | United Kingdom | 100/272 |

*Primary Examiner*—Harvey C. Hornsby
*Assistant Examiner*—Stephen F. Gerrity
*Attorney, Agent, or Firm*—Wenderoth, Lind & Ponack

[57] ABSTRACT

A press apparatus is disclosed which includes a bed, a pair of opposing ram guides fixedly mounted to the bed, and a ram slidably mounted to the ram guides for linear movement relative to the bed. A pair of pull links is arranged on opposing sides of the ram, and a pull link support shaft is provided to pivotably mount the lower ends of the pull links to the bed for pivotal movement together relative to the bed. A pair of lever links is arranged on opposing sides of the ram, and a lever link support shaft is provided to pivotally mount the pair of lever links to the ram for pivotal movement together relative to the ram. A first connecting shaft is provided to pivotally mount the upper end of each of the pull links to a respective one of the lever links. A reciprocating cylinder device is operatively connected to the lever links in order to selectively force the lever links to pivot together in first and second rotational directions relative to the ram when operated in first and second selected manners. Such pivoting of the lever links forces the pull links to pivot together relative to the bed and, in turn, forces the ram to move linearly relative to the ram guides.

13 Claims, 13 Drawing Sheets

FIG. 18 - PRIOR ART

FIG. 19 - PRIOR ART

FIG. 20 - PRIOR ART
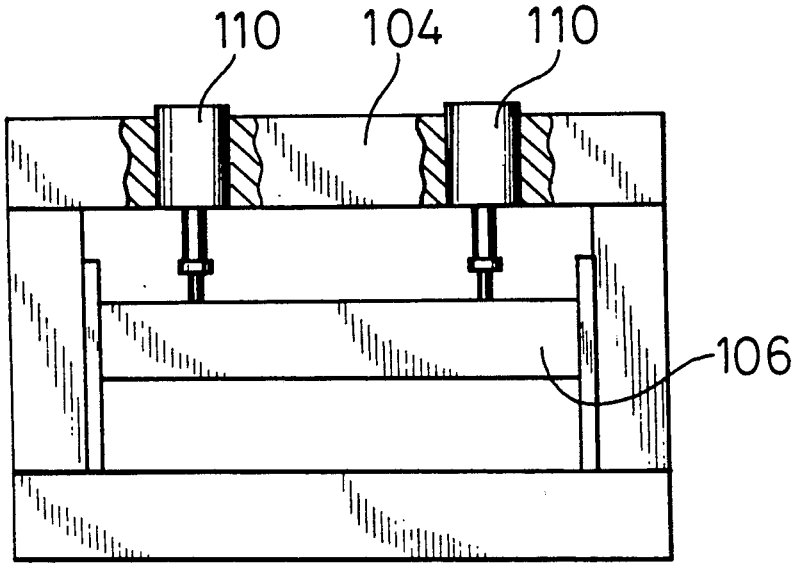
FIG. 21 - PRIOR ART
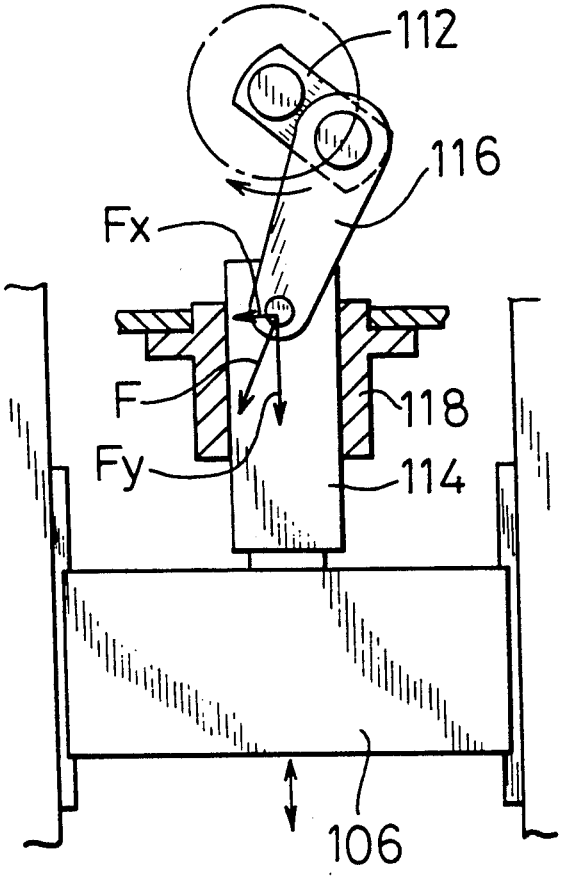

PRESS APPARATUS

BACKGROUND OF THE INVENTION

1. Field of the Invention

This invention relates to a press apparatus which connects a bed and a ram by lever links and pull links, and causes the reciprocating rotary motion of the lever links and pull links by a driving device to move the ram up and down, thus eliminating the necessity for a frame having a rigid structure and providing high dynamic accuracy and high resistance against an eccentric load.

2. Description of the Prior Art

Recently, higher machining accuracy and higher productivity for press work have been increasing.

In other words, since multiple-stage dies have found a wider application due to automation by robot and progressive forming, a press having higher resistance against an eccentric load and having higher dynamic accuracy has been required to cope with such changes. However, the presses that presently satisfy these requirements are large in scale and expensive.

Typical frames of the presses have a C-shape such as shown in FIG. 18 or a gate-shape such as shown in FIG. 19, each of which has a rigid structure. The C-shaped frame provides lower press force and lower machining accuracy than the gate-shaped frame. Therefore, the gate-shaped frame is used for machining requiring high press force and high machining accuracy.

In either of these frames, when the press force and its reaction act at the time of machining, a bed portion 102 and a crown portion 104 undergo deformation as represented by the two-dot-chain line in the drawings.

Upper and lower dies of the press are fitted to the ram portion 106 and the bed portion 102, respectively. The press force and its reaction act as a bending moment on the bed portion 102 and the ram portion 106 at the time of machining, and the bed portion 102 and the ram portion 106 undergo deformation, which in turn, cause deformation of the dies fitted thereto. If the dies undergo deformation, machining accuracy drops and the service life of the dies is shortened.

The bending deformation resulting from the bending moment among the deformations of the press frame exerts particularly adverse influences on machining accuracy and service life of the metallic mold. Therefore, its bending deformation must be minimized.

Rigidity or stiffness of the frame having the rigid structure must be improved in order to reduce its bending deformation. To improve stiffness of the frame, the section modulus of the bed portion 102, crown portion 104, ram portion 106, etc, that constitute the frame must be improved. To attain this object, it is most effective to increase the height of each of these members.

If the height of each of the bed portion 102, crown portion 104 and ram portion 106 constituting the frame is increased, however, the total length of the frame is increased, and a large-scale press cannot be installed in a workshop unless part of its bed portion is embedded by boring a pit. In addition, the increased length of the press cause, the total weight of the press increase. Besides these disadvantages, it becomes difficult to assemble the large scale structures, such as the bed portion 102, the crown portion 104, the ram portion 106 and the upright portion 108 with a high level of accuracy while properly maintaining the respective horizontal and vertical orientations. Eventually, this results in an increase in the cost of the press apparatus.

As shown in FIG. 20, if a multiple-point hydraulic press which is highly resistant to the eccentric load is provided by fitting a plurality of hydraulic cylinders 110 to the crown portion 104 in order to move the ram portion 106 up and down, a synchronization mechanism for synchronizing the operations of the hydraulic cylinders 110 becomes indispensable. Such synchronization mechanism is complicated in construction and is expensive.

FIG. 21 shows a crank press of a mechanical system, which includes a crank rod 112 and a plunger 114 connected together by a connecting rod 116. A ram portion 106 is fitted to the plunger 114 and the plunger 114 is caused to slide inside a plunger guide 118. This plunger guide 118 is arranged to remove a horizontal component (Fx) of the press force (F) and to improve dynamic accuracy. However, this crank press involves the problem that the press is large in scale and expensive, due to the provision of the mechanism for removing the horizontal component of the press force by the plunger and the plunger guide is disposed.

SUMMARY OF THE INVENTION

In the press apparatus in accordance with the present invention, pull links are disposed on both sides of a ram guide disposed integrally with a bed and are supported by ram guides through a pull link support shaft, and lever links are disposed on opposing sides at the upper end portion of the ram guides and are supported by the upper end portion of the ram guides through a lever link support shaft. The pull links and the lever links are connected to one another so as to thereby connect the bed and the ram through the pull links and the lever links, and a drive cylinder device lets the pull links and the lever links perform reciprocating rotary motion so as to vertically move the ram.

When the lever links disposed on both sides of the upper end portion of the ram are subjected to reciprocating rotary motion by the drive device with the lever link support shaft as the center, the pull links connected to the lever links perform reciprocating rotary motion in synchronism with each other. This reciprocating rotary motion of the pull links vertically moves the ram, and the reaction of the press force acts on the pull link support shaft so that the press work can be carried out continuously.

Since the press force is applied to the ram due to the rotation of the pull links and the pull links are disposed on both sides of the ram guides, it is possible to provide a press apparatus which is highly resistant to eccentric loads along the axial direction of the pull link support shaft supporting the pull links and which has high dynamic accuracy.

Further, since the bed and the ram are connected to each other with hinge-joints of the lever links and the pull links, a rigid press frame that has been indispensable in conventional press apparatuses, becomes unnecessary and the total height of the press apparatus can be reduced.

BRIEF DESCRIPTION OF THE DRAWINGS

The present invention will be more fully described with reference to the accompanying drawings, wherein:

FIGS. 18 through 21 are views useful for explaining conventional press apparatuses, wherein:

FIG. 18 is a side view of a press apparatus having a C-shaped press frame;

FIG. 19 is a front view of a press apparatus having a gate-shaped press frame;

FIG. 20 is a front view of a press apparatus using a plurality of hydraulic cylinders; and FIG. 21 is partial view of a plunger guide of a crank press.

DESCRIPTION OF THE PREFERRED EMBODIMENTS

FIGS. 1 through 7 show the press apparatus ($P_1$) in accordance with a first embodiment of the present invention.

Figure 2:
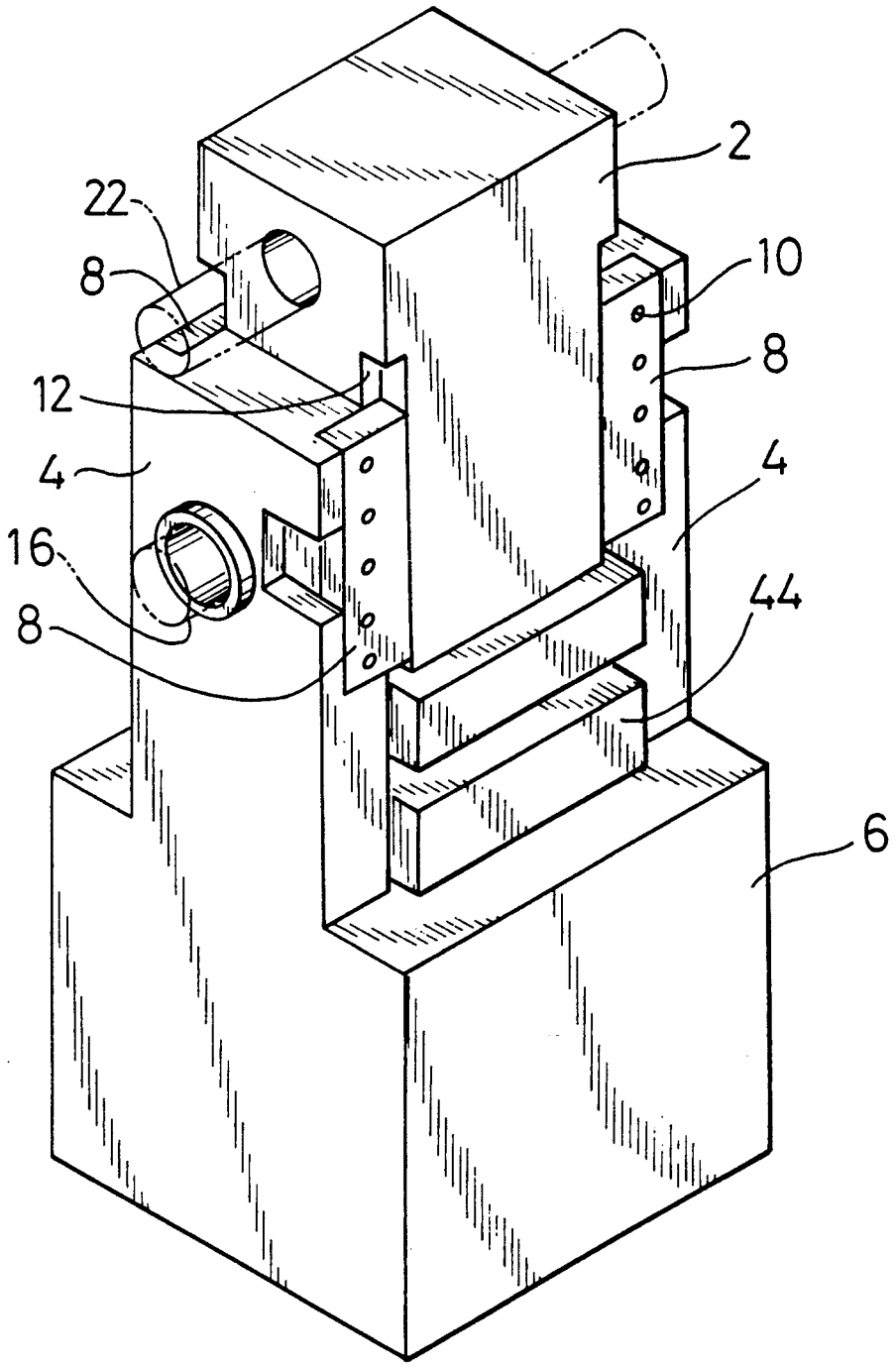
FIG. 2 is a perspective view of the press apparatus of FIG. 1 only partially assembled.
Figure 5:
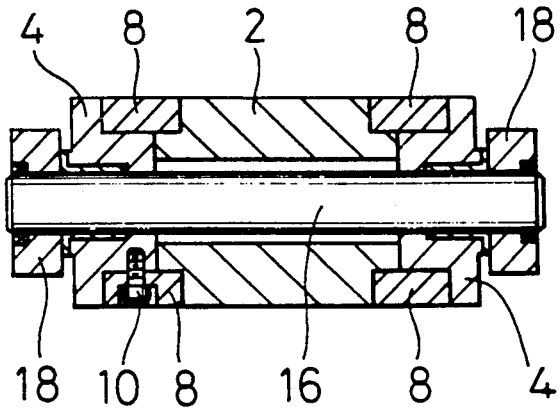
FIG. 5 is a sectional view taken along line X—X in FIG. 4.

A pair of ram guides 4 are formed or otherwise mounted integrally with a bed 6 in order to guide vertical movement of a ram 2. These ram guides 4 are disposed in such a manner as to face each other in a horizontal direction with a predetermined gap between them. As shown in FIGS. 2 and 5, guide plates 8 are fitted to the front and rear surfaces of each guide 4 by fixing bolts 10 spaced vertically along the guide plates, each guide plate 8 projecting inwardly by a predetermined length from the inner surface of each ram guide 4.

Figure 3:
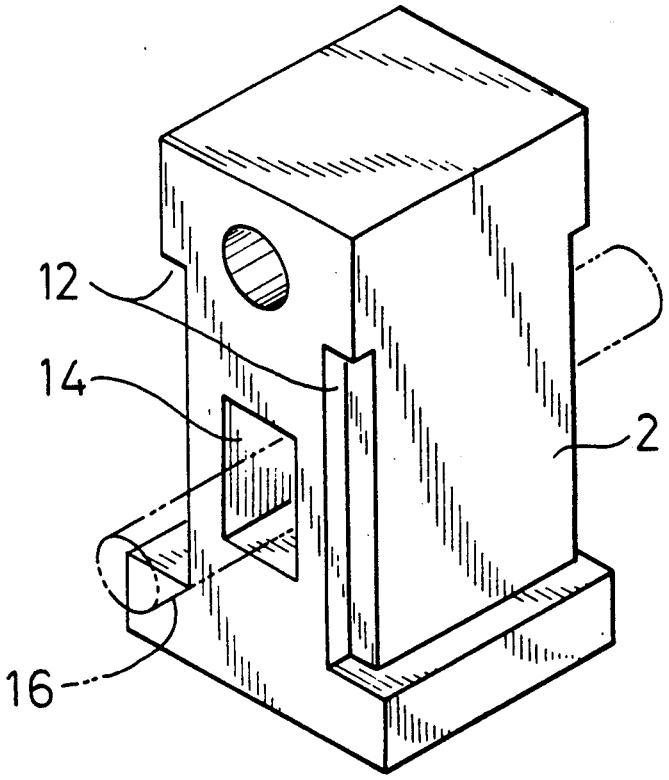
FIG. 3 is a perspective view of a ram of the press apparatus of FIG. 1.

As shown in FIGS. 2 and 3, the ram 2 has a rectangular shape, and fitting grooves 12 extending in the vertical direction are defined at four corners of the ram 2. A shaft insertion hole 14 for the insertion of a pull link support shaft 16 is bored in the horizontal direction through the center portion of the ram 2.

As shown in FIG. 2, with the guide plates 8 mounted to respective ram guides 4, the ram 2 fits between the pair of ram guides 4 with the guide plates being slidably fitted in the fitting grooves 12, respectively, such that the ram 2 can be guided by the ram guides as it moves up and down.

Figure 1:
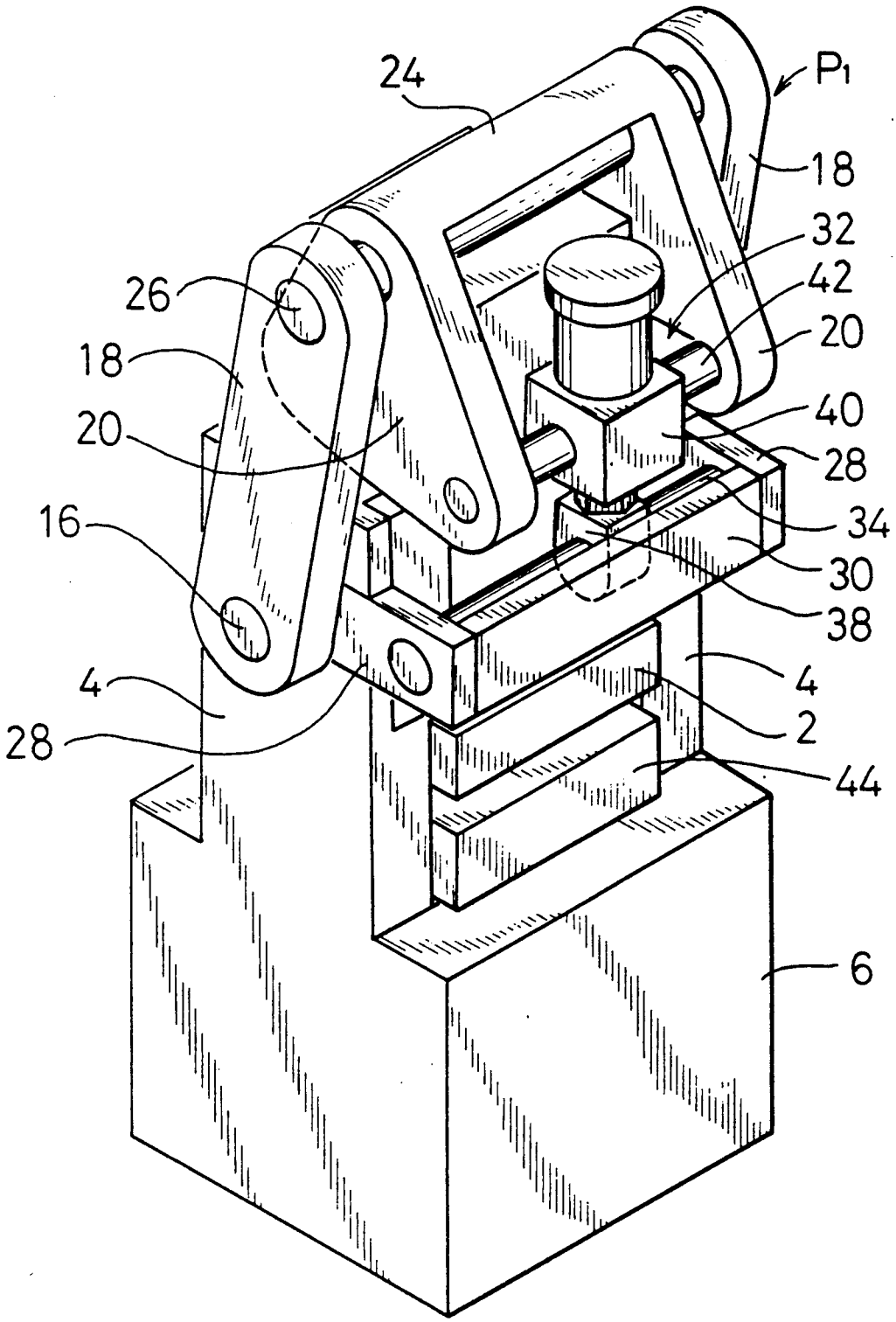
FIG. 1 is an overall rear perspective view of a press apparatus according to a first embodiment of the invention.
Figure 4:
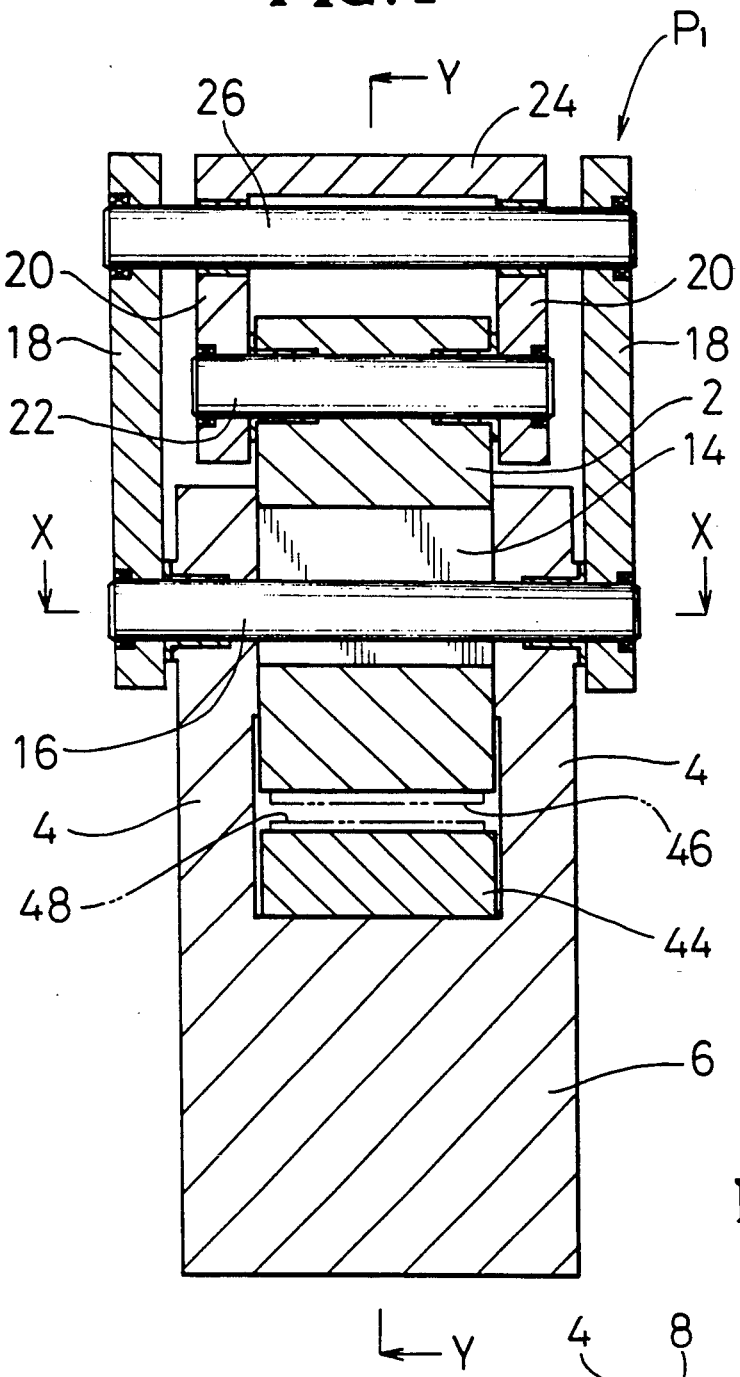
FIG. 4 is a sectional front view of the press apparatus of FIG. 1 with the ram positioned at its upper end position.

As shown in FIGS. 1 and 4, the pull link support shaft 16 is supported in the horizontal direction at the upper end of the pair of ram guides 4 each other. A pair of pull links 18 are disposed on outer sides of the ram guides 4, respectively, with their lower end portions supported by the pull link support shaft 16. A pair of lever links 20 are disposed on opposing sides of the upper end portion of the ram 2 that projects from the upper end of the pair of ram guides 4, and each lever link 20 is supported by the upper end portion of the ram 2 through the lever link support shaft 22 which is in parallel with the pull link support shaft 16 described above. The pair of lever links 20 are connected integrally by a connecting member 24 so as to rotate integrally with each other.

The respective upper end portion of the pull link 18 and the lever link 20 are connected to each other through a first connecting shaft 26 which is in parallel with the pull link support shaft 16.

Figure 6:
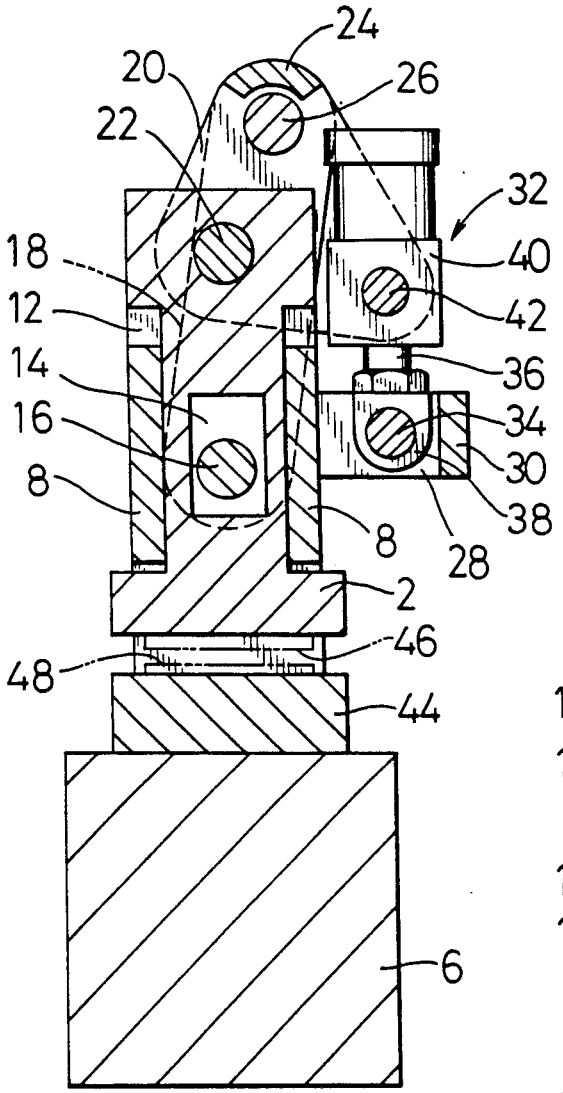
FIGS. 6 and 7 are sectional views along line Y—Y of FIG. 4 with the ram in upper and lower end positions, respectively.

As shown in FIGS. 1 and 6, support plates 28 are fixed horizontally at the rear surfaces of the upper end portions of the pair of ram guides 4 in such a manner as to project rearwardly therefrom. The support plate 28 are connected together by a connecting plate 30. Therefore, since the upper end portions of the pair of ram guides 4 are connected by the connecting plate 30, the stiffness of the ram guides 4 is improved.

A cylinder device support shaft 34 for supporting a hydraulic drive cylinder device 32 is supported between the support plates 28 fixed to the upper end portions of the ram guides 4 in parallel with the pull link support shaft 16 described above. The drive cylinder device 32 is disposed between the pair of lever links 20 and has a downwardly extending piston rod 36. A knuckle 38 fitted to the tip of the rod 36 of this drive cylinder device 32 is supported rotatably by the cylinder device support shaft 34 described above. A main cylinder body 40 and each lever link 20 are connected to each other by a second connecting shaft 42 which is in parallel with the pull link support shaft 16 described above.

A die fitting table 44 is fixed to the bed 6 and upper and lower dies 46 and 48 are fitted to the lower surface of the ram 2 and to the upper surface of the die fitting table 44, respectively.

Next, the operation of the press apparatus ($P_1$) having the construction described above will be explained. Incidentally, FIGS. 4 and 6 show the state where the ram 2 is positioned at its upper end position, and FIG. 7 shows the state where the ram 2 is positioned at its lower end position.

When the drive cylinder device 32 is actuated and its rod 36 is moved in and out, the pair of lever links 20 perform integrally reciprocating rotary motion with the lever link support shaft 22 as the center. This reciprocating rotary motion of the lever links 20 in turn causes reciprocating rotary motion of the pair of pull links 18 in synchronism with each other with the pull link support shaft 16 as the center.

Figure 7:
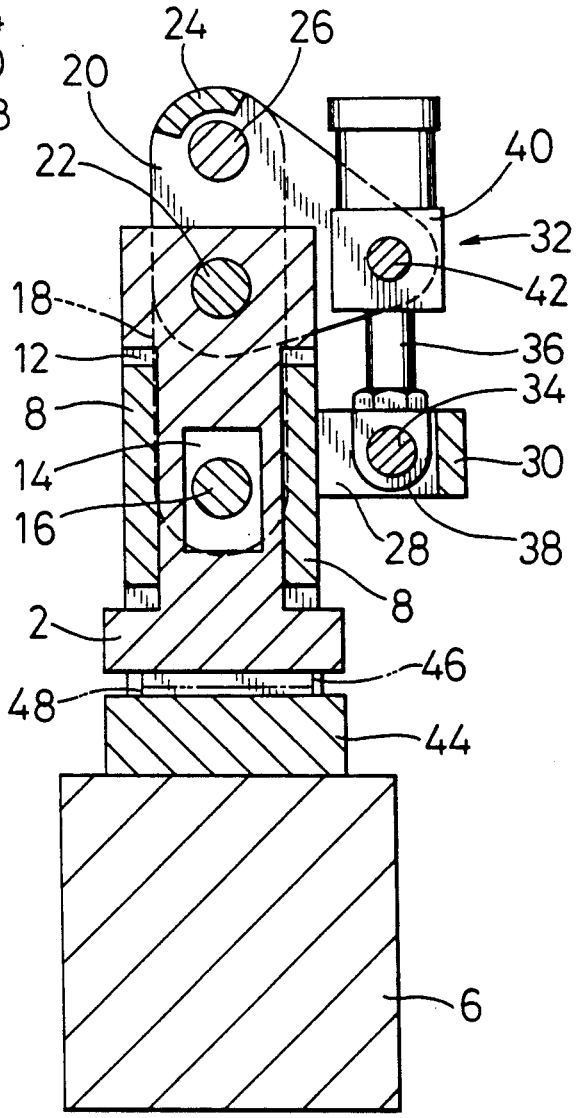
Figure 8:
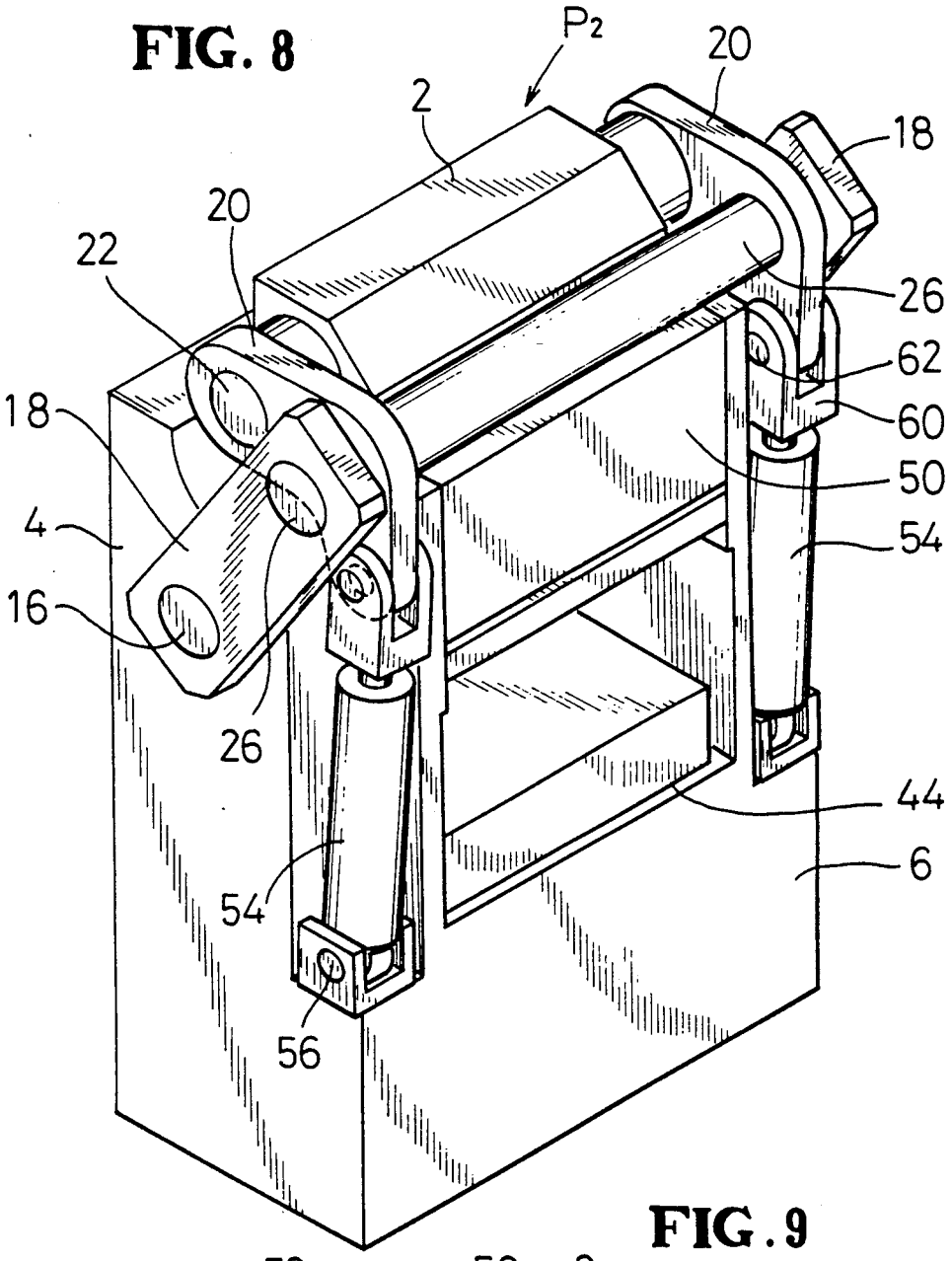
FIG. 8 is an overall rear perspective view of a press apparatus according to a second embodiment of the invention.
Figure 9:
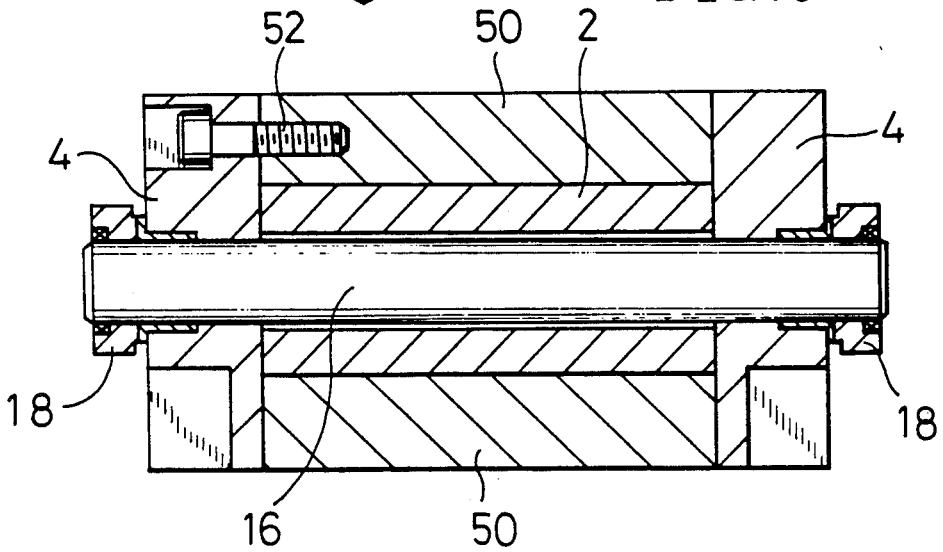
FIG. 9 is a sectional plan view of a pull link support shaft of the press apparatus of FIG. 8.

Due to this link motion, the ram 2 moves up and down through a predetermined stroke between its upper end position and its lower end position shown in FIGS. 6 and 7, respectively, while being guided by the ram guides 4. The reaction of the press force acts on the pull link support shaft 16 so that press work is continuously effected between the upper and lower dies 46, 48.

Here, since the pair of pull links 18 are driven by a single drive cylinder device 32, they are reciprocated in synchronism with each other. Accordingly, since, while the ram 2 is moved up and down, is accurately maintained in parallel with the bed 6, dynamic accuracy of the press apparatus can be maintained and accuracy of the press work can be improved.

Since the pair of pull links 18 are disposed on both sides of the ram guides 4, they have a structure which is highly resistant to an eccentric load along the axial direction of the pair of pull link support shafts 16 and moreover, have high dynamic accuracy. In this embodiment, the axes of the pull link support shaft 16, lever link support shaft 22 and first connecting shaft 26 are substantially on the same line when the ram 2 is at its lower end position (see FIG. 7). Therefore, the mechanism of the connecting portion between the pull link 18 and the lever link 20 works as a toggle mechanism. Accordingly, the press force becomes by far greater than the driving force of the drive cylinder device 32 and for this reason, the capacity of the drive cylinder device 32 to be used may be relatively small, thereby accomplishing energy savings.

FIGS. 8 to 11 show a press apparatus ($P_2$) according to a second embodiment of the present invention.

The basic construction of the press apparatus ($P_2$) is substantially the same as that of the press apparatus ($P_1$) described above in that the ram 2 is moved up and down by the link mechanism consisting of the pair of pull links 18 and the pair of lever links 20, but is different from the press apparatus ($P_1$) in that the press apparatus ($P_2$) uses two drive cylinder devices 54 for actuating the link mechanism and in that the stroke of the ram 2 is increased.

Accordingly, like reference numerals will be used to identify like constituents as in the press apparatus ($P_1$) described above (inclusive of the constituents which are substantially the same), and only the different portions will be explained.

The pair of integrally connected ram guides 4 are disposed on the bed 6 with a predetermined gap between them in the horizontal direction in such a manner as to face each other, and a pair of guide blocks 50 for guiding elevation of the ram 2 are integrally connected to the upper part of the ram guides 4 by fixing bolts 52 and have a predetermined gap between them. The ram 2 is disposed between the pair of guide blocks 50 and the pair of ram guides 4, such that it is guided by the guide blocks 50 and ram guides 4 as it is being moved up and down guided by.

The drive cylinder devices 54 are disposed at the back portions of the ram guides 4 with their lower end is supported by the bed 6 through respective pivot pins 56. The lever links 20 are disposed on both sides of the ram 2. The pair of lever links 20 are supported by the lever link support shaft 22 at the upper end of the ram 2.

The pull links 18 are disposed an outer sides of the ram guides 4, respectively, and the lower end of each pull link 18 is supported by the ram guide 4 through the pull link support shaft 16. The pair of lever links 20 disposed on both sides of the ram 2 and the pair of pull links 18 disposed on both sides of the ram guide 4 are connected mutually through the first connecting shaft 26. Each of the lever links 20 disposed on both sides of the ram 2 is connected to the rod 58 of the drive cylinder device 54 through the knuckle 60 and the pin 62.

Figure 10:
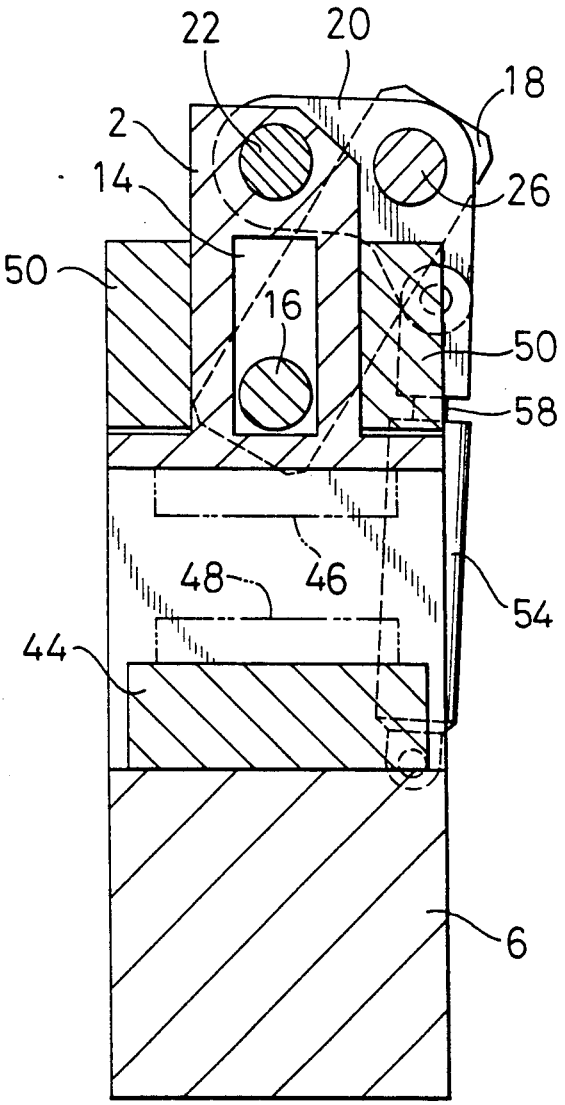
FIGS. 10 and 11 are sectional side views of the press apparatus of FIG. 8 with a ram at its upper and lower end positions, respectively.
Figure 11:
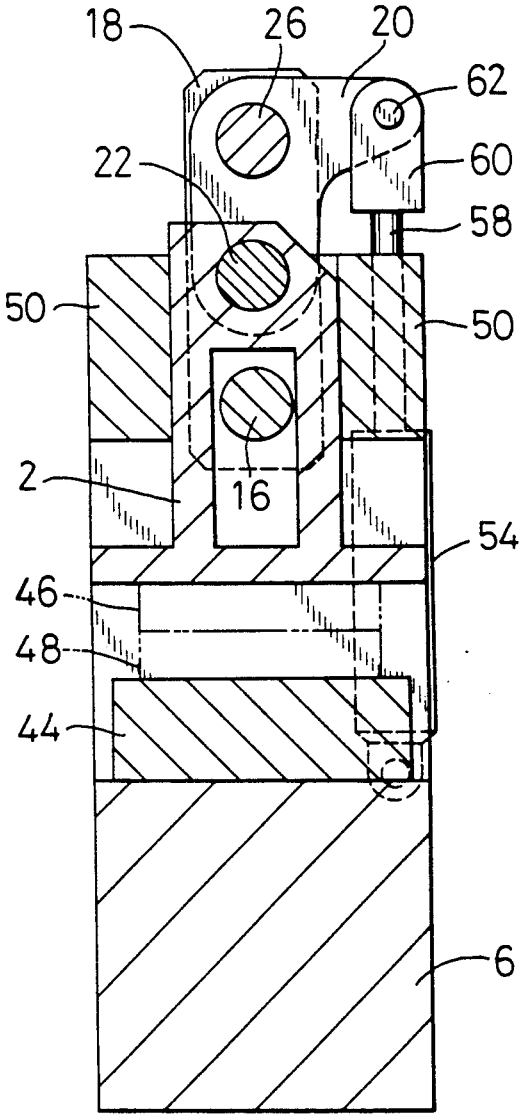

FIGS. 10 and 11 show the states where the ram 2 is positioned at its upper position and at its lower position, respectively. When each drive cylinder device 54 is actuated and its rod 58 is moved in and out, the pair of lever links 20 perform reciprocating rotary motion with the lever link support shaft 22 as the center. Due to the reciprocating rotary motion of the lever link 20, the pair of pull links 18 are synchronously reciprocated with the pull link support shaft 16 as the center. Accordingly, the ram 2 is moved up and down with a predetermined strokes and the reaction of the press force acts on the pull link support shaft 16 so that the press work is carried out continuously between the upper and lower dies 46, 48.

The link mechanism of this press apparatus ($P_2$) consisting of the pair of lever links 20 and the pair of pull links 18 is actuated by the two drive cylinder devices 54. Since the right and left lever links 20 and pull links 18 are connected to one another by the common first connecting shaft 26 and are thus restricted one another, the of the right and left lever links 20 and pull links 18 are forced to move in synchronism with one another.

Since the base end of each drive cylinder device 54 is supported by the bed 6 through the pin 56, the stroke of its rod 58 is increased, thereby increasing the stroke of the ram 2.

FIGS. 12 through 17 show the press apparatus ($P_3$) in accordance with a third embodiment of the present invention. This press apparatus ($P_3$) has a structure wherein two pull links 18 and lever links 20 are disposed on each of two opposing sides of the ram guides 4 and the ram 2, respectively, and in this aspect, this press apparatus ($P_3$) is different from the press apparatuses ($P_1$) and ($P_2$) described already.

Figure 12:
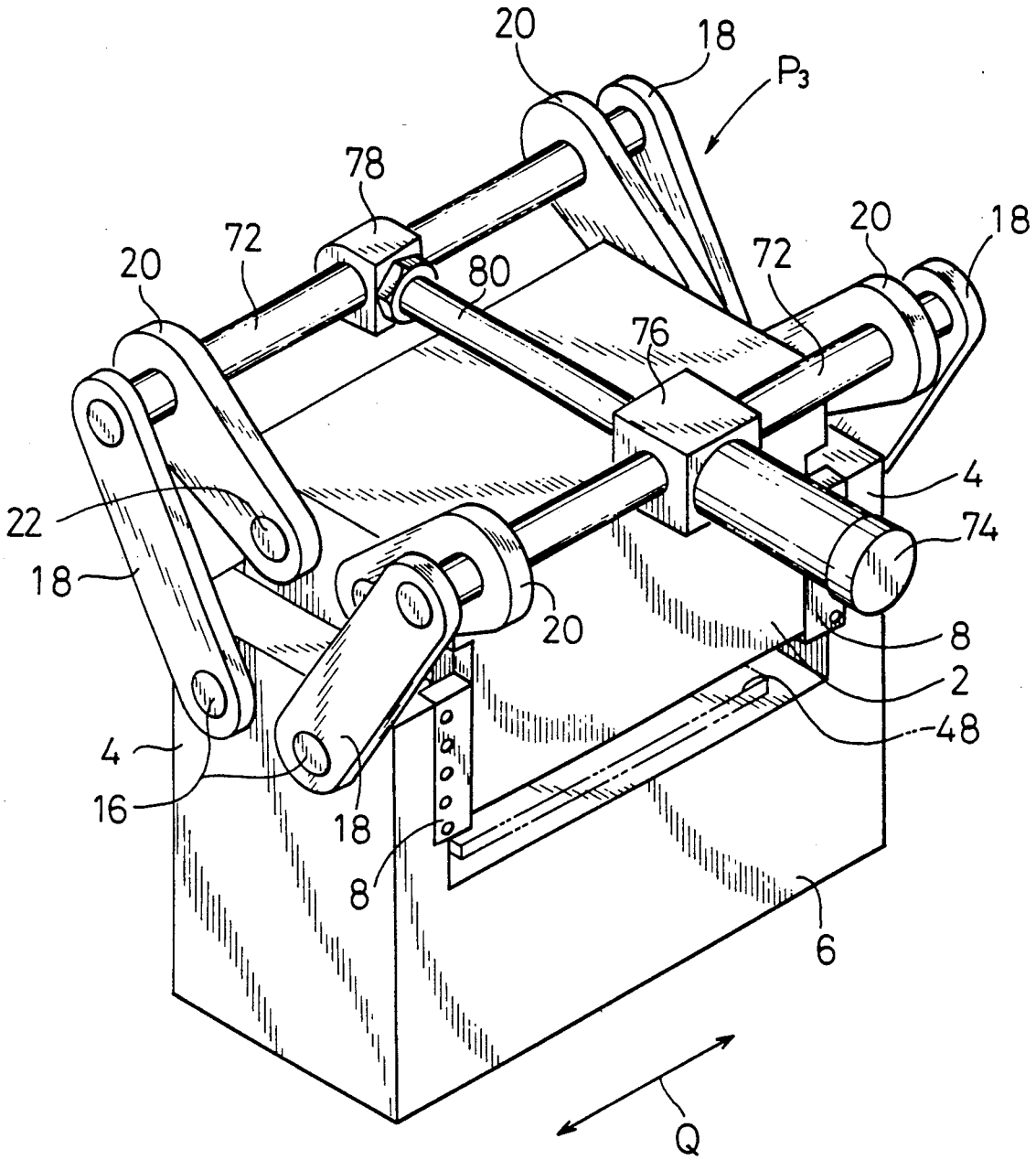
FIG. 12 is a perspective view of a press apparatus according to a third embodiment of the invention.
Figure 13:
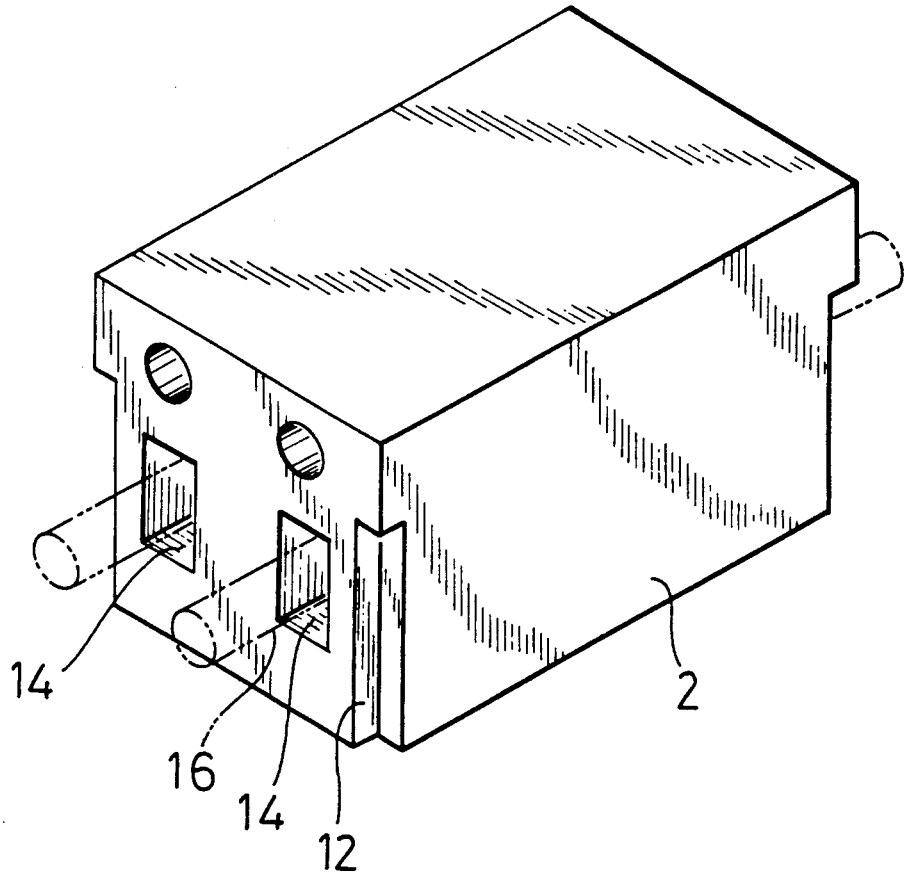
FIG. 13 is a perspective view of the ram of the press apparatus of FIG. 12.
Figure 14:
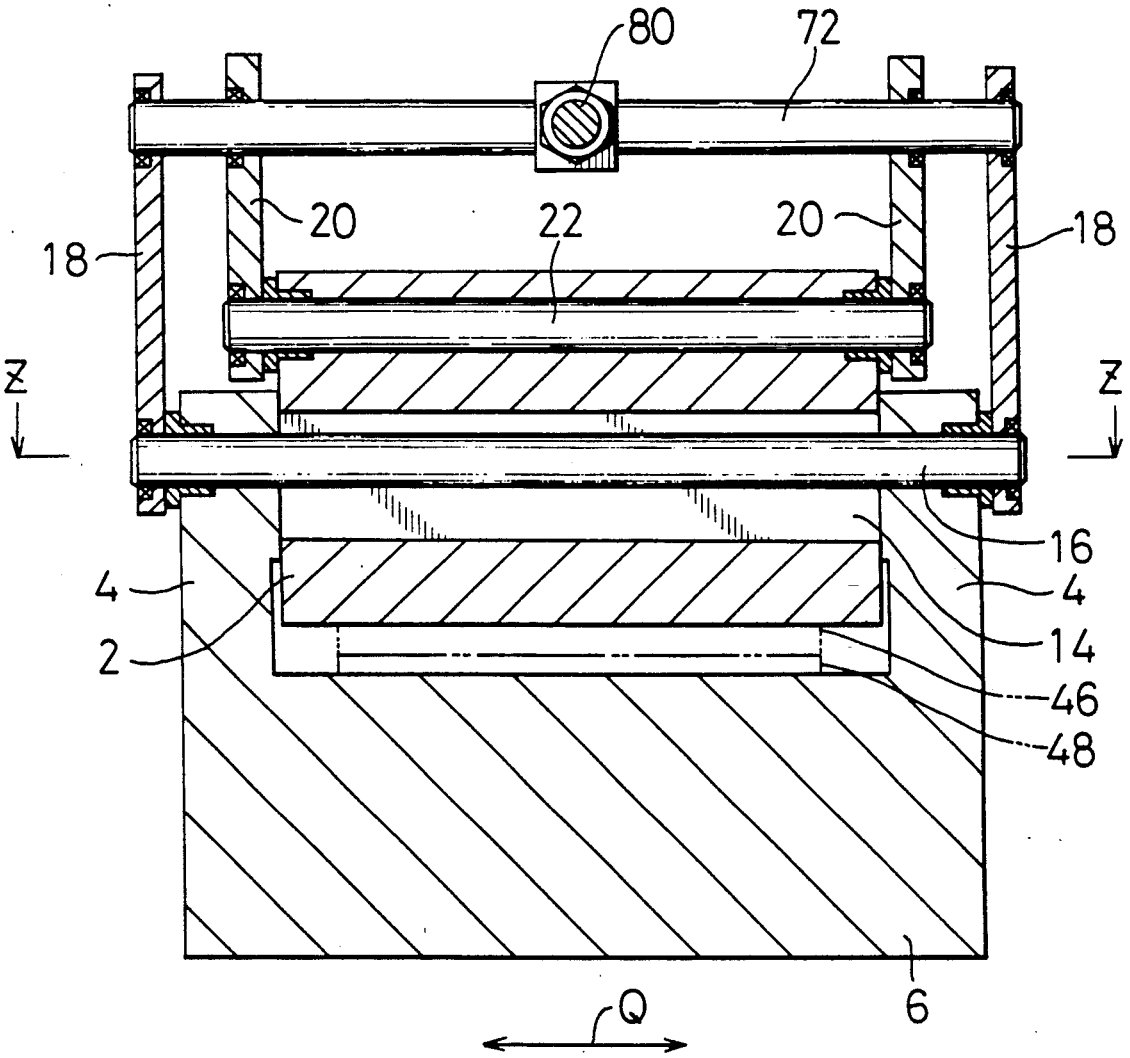
FIG. 14 is a sectional front view of the press apparatus of FIG. 12 with the ram positioned at its lower end position.
Figure 15:
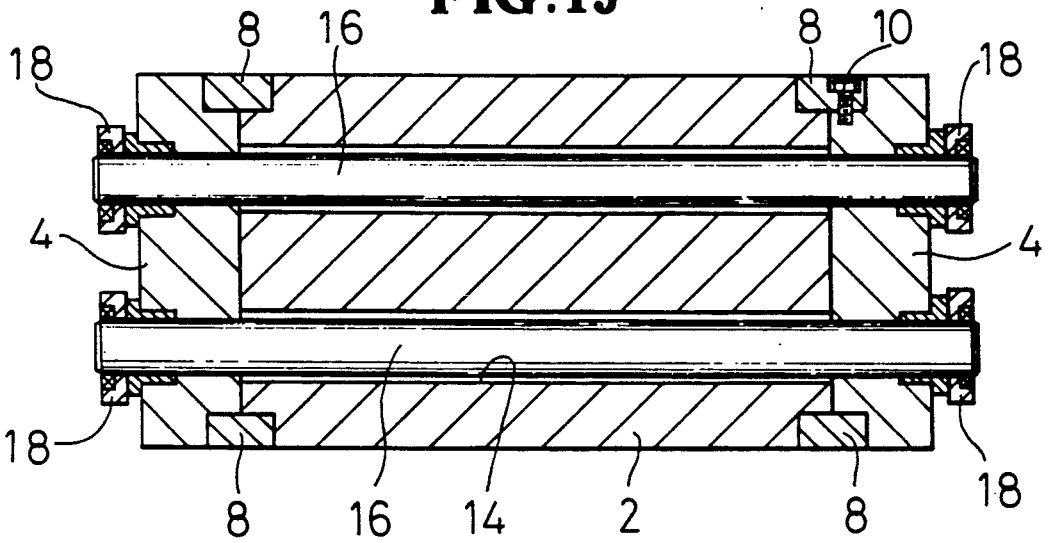
FIG. 15 is a sectional view taken along line Z—Z of FIG. 14.

As shown in FIG. 13, the fitting grooves 12, are formed in the ram 2 and extend in the vertical direction, and the two shaft insertion holes 14 for the insertion of the pull link support shafts 16 are bored horizontally at the center of the ram 2 with a predetermined gap between them. As shown in FIGS. 12 and 15, the ram 2 is fitted between the pair of ram guides 4 disposed facing each other, such that it can be moved up and down, with the guide plates 8 mounted to the ram guides 4 received in the fitting grooves 12 of the ram 2, respectively.

Figure 16:
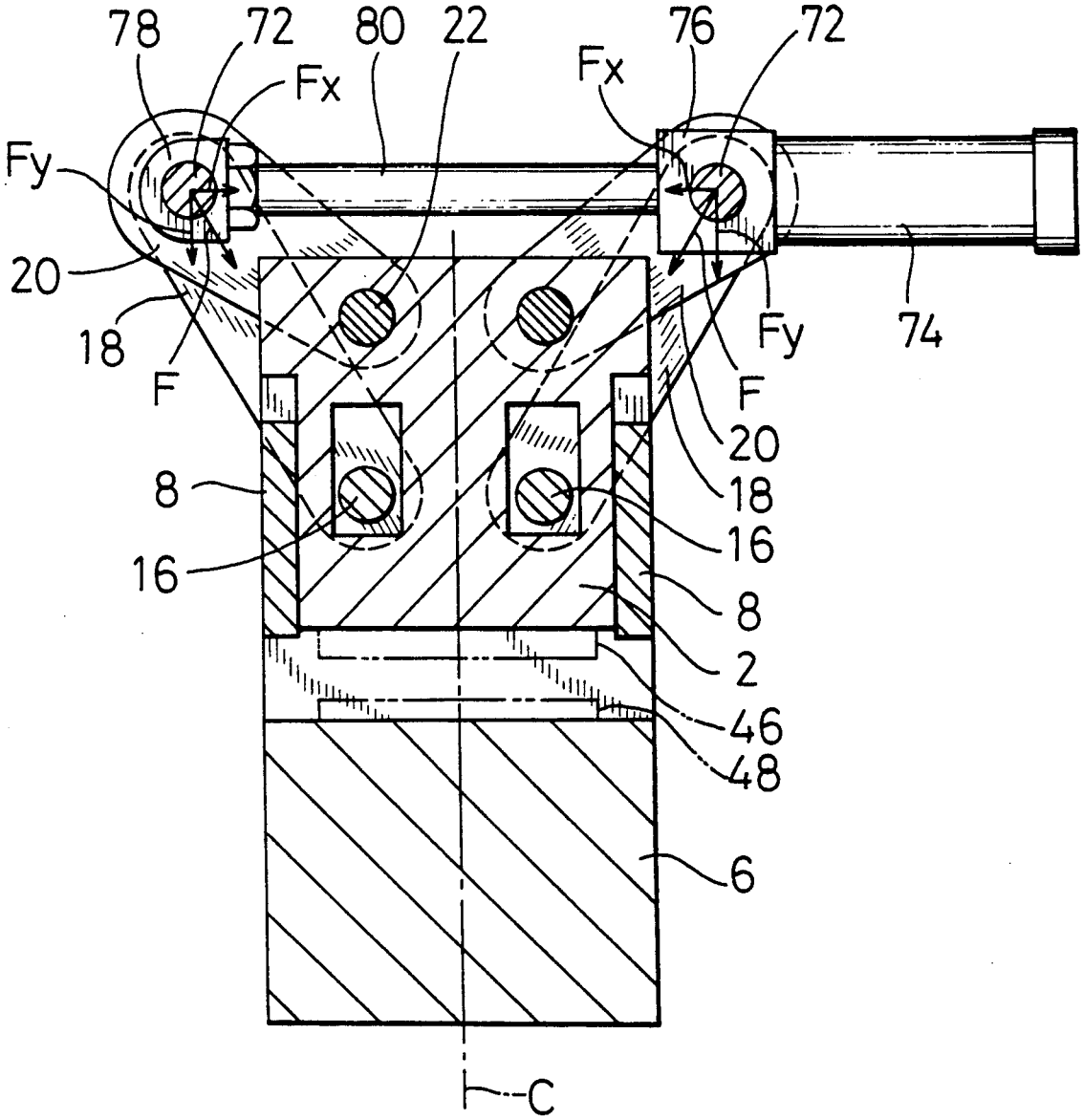
FIGS. 16 and 17 are sectional side views of the press apparatus of FIG. 12 with the ram at its upper and lower end positions, respectively.
Figure 17:
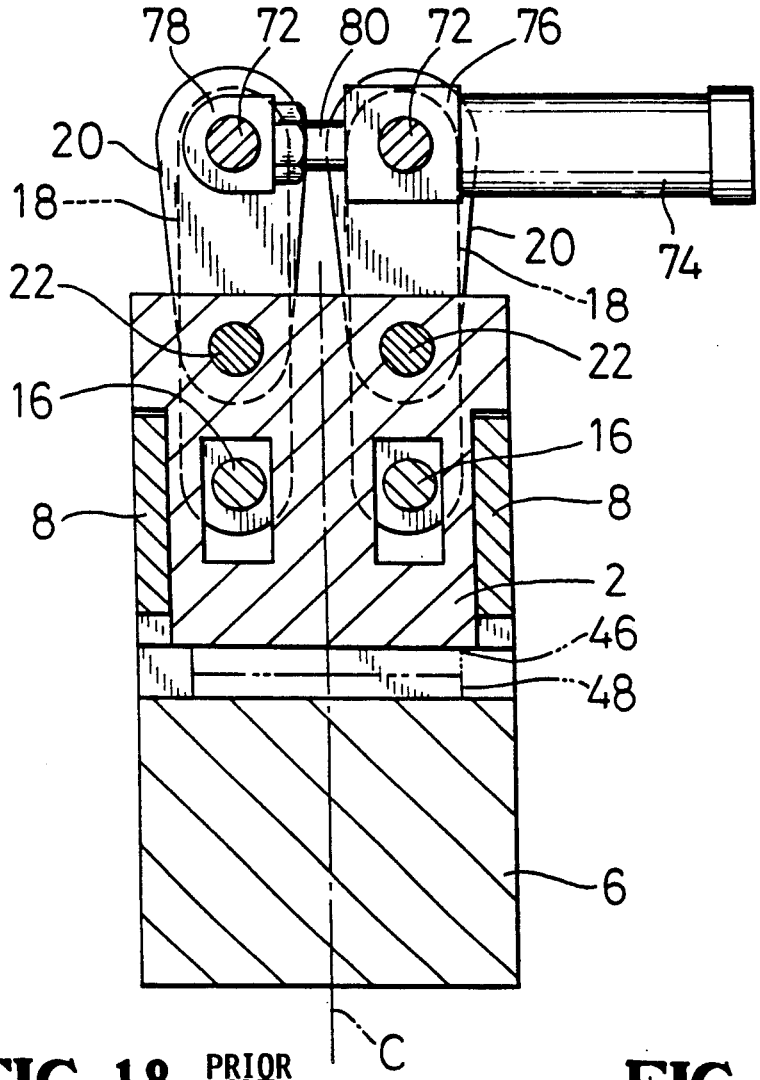
Figure 17:
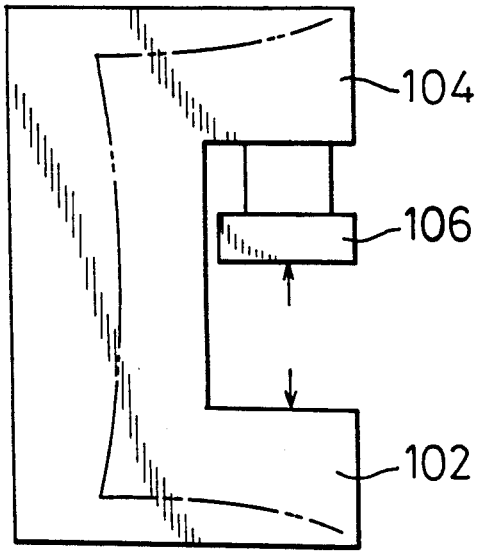
Figure 17:
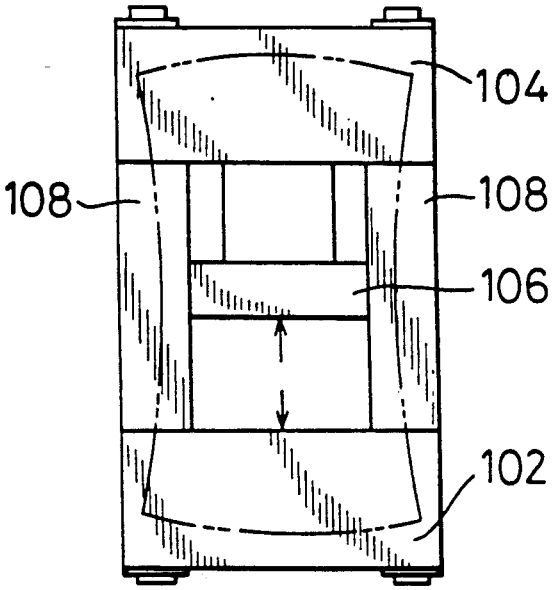

As shown in FIGS. 12 and 16, a pair of pull link support shafts 16 are disposed in such a manner as to be symmetric with each other with respect to the vertical center line (C) of the side surface of the bed 6 and are supported horizontally by the ram guides 4 disposed integrally on both side portions of the bed 6. The pull link support shafts 16 are inserted into the shaft insertion holes 14 bored in the ram 2. Similarly, the pair of lever link support shafts 22 are disposed in such a manner as to be symmetric with each other with respect to the vertical center line (C) of the side surface of the bed 6 described above, and are supported horizontally at the upper end portion of the ram 2.

Two pull links 18 are disposed on each of the two opposing side surfaces of the ram guides 4, and the lower end portion of each pull link 18 is supported by the pull link support shaft 16. Similarly, two lever links 20 are disposed on each of the two opposing side surfaces of the ram 2, and the lower end portion of each lever link 20 is supported by the lever link support shaft 22. Accordingly, one pull link 18 and lever link 20 are disposed on each side of the vertical center line (C) on each side surface of the bed 6. In other words, the two pull links 18 face each other and the two lever links 20 also face each other in the longitudinal direction (Q) of the bed 6, and these four links are connected by the common connecting shafts 72, respectively.

The two connecting shafts 72 that connect these four links are connected by one drive cylinder device 74. In other words, the main cylinder body 76 is supported by one of the connecting shafts 72, and the knuckle 78 is supported by the other of the connecting shafts 72. The tip portion of the rod 80 of a piston drive cylinder device 74 is connected to the knuckle 78.

When the drive cylinder device 74 is actuated and its rod 80 is moved in and out, the four pull links 18 perform reciprocating rotary motion with each pull link support shaft 16 as the center and at the same time, the four lever links 20 perform reciprocating rotary motion with each lever link support shaft 22 as the center. Due to this link motion, the ram 2 is moved up and down with a predetermined stroke between the upper and lower end positions shown in FIGS. 16 and 17 while being guided by the ram guides 4, and the reaction of the press force acts on the pull link support shafts 16 so that the press work is carried out continuously between the upper and lower dies 46, 48.

In this press apparatus ($P_3$), two pull link support shafts 16, which function as the load point, are disposed. Therefore, as shown in FIG. 16, the horizontal component of force (Fx) of the press force (F) acting on the pull link support shafts 16 is offset and only the vertical component of force (Fy) which is effective for pressing remains. As a result, since the horizontal component of force (Fx) which is irrelevant to pressing is not imparted to the guide portions such a the guide plates 8 and the ram guides 4, dynamic accuracy of the ram is high, such being a unique advantage of the present invention.

What is claimed is:

1. A press apparatus comprising:

a bed;

a pair of opposing ram guides fixedly mounted to said bed;

a ram having an upper end and a lower end and being slidably mounted to said ram guides for linear movement relative to said bed;

a pair of pull links arranged on opposing sides of said ram and having upper ends and lower ends;

pull link support means for pivotally mounting said lower ends of said pull links to said bed for pivotal movement together relative to said bed and such that said pull links are opposed to one another;

a pair of lever links arranged on opposing sides of said ram;

lever link support means for pivotally mounting said pair of lever links to said ram for pivotal movement together relative to said ram;

first connecting means for pivotally mounting said upper end of each of said pull links to a respective one of said lever links; and drive means, comprising at least one reciprocating cylinder device operatively connected to said lever links, for forcing said lever links to pivot together in a first lever link rotational direction relative to said ram when said cylinder device is operated in a first selected manner, to thereby force said pull links to pivot together in a first pull link rotational direction relative to said bed and, in turn, force said ram to move linearly relative to said ram guides in a first linear direction, and for forcing said lever links to pivot together in a second lever link rotational direction, opposite said first lever link rotational direction, relative to said ram when said cylinder device is operated in a second selected manner, to thereby force said pull links to pivot together in a second pull link rotational direction, opposite said first pull link rotational direction and, in turn, force said ram to move linearly in a second linear direction, opposite said first linear direction.

2. A press apparatus as recited in claim 1, wherein said pull link support means comprises a pull link support shaft mounted to and extending between said ram guides and mounted to said lower ends of said pull links; and said lever link support means comprises a lever link support shaft extending horizontally through said ram and mounted to said lever links.

3. A press apparatus as recited in claim 2, wherein said ram has a vertically elongated shaft insertion hole extending horizontally therethrough for receiving said pull link support shaft.

4. A press apparatus as recited in claim 1, wherein said at least one cylinder device is operatively and pivotally connected between said bed and said lever links.

5. A press apparatus as recited in claim 1, wherein said at least one cylinder device comprises two cylinder device, each of which is pivotally connected at a lower end to said bed and is pivotally connected at an upper end to a respective one of said lever links.

6. A press apparatus as recited in claim 1, wherein said at least one cylinder device comprises two cylinder devices;

an upper end of each of said cylinder devices is pivotally connected to a first end of one of said lever links;

each of said lever links is pivotally connected at a second end thereof to said ram; and each of said pull links is pivotally connected at an upper end thereof to one of said lever links at a location on said one of said lever links intermediate said first and second ends thereof.

7. A press apparatus as recited in claim 1, further comprising a pair of guide blocks fixed to and extending between said ram guides; and wherein said ram is slidably mounted between said guide blocks.

8. A press apparatus as recited in claim 1, wherein said first connecting means comprises a first connecting shaft mounted to and extending between said lever links and mounted to said upper ends of said pull links.

9. A press apparatus as recited in claim 1, further comprising a second connecting shaft mounted to and extending between said lever links and mounted to said cylinder device, for pivotally connecting said cylinder device to said lever links.

10. A press apparatus as recited in claim 9, further comprising a pair of support plates fixed to and extending from said pair of ram guides, respectively; and a cylinder support shaft mounted to and extending between said support plates, said cylinder device having a lower end thereof mounted to said cylinder support shaft between said support plates.

11. A press apparatus as recited in claim 10, further comprising a connecting plate fixed to and extending between said support plates.

12. A press apparatus as recited in claim 1, further comprising an additional pair of pull links arranged on opposing sides of said ram;

an additional pull link support means for pivotally mounting lower ends of said additional pull links to said bed for pivotal movement together relative to said bed;

an additional pair of lever links arranged on opposing sides of said ram;

an additional lever link support means for pivotably mounting said additional pair of lever links to said ram for pivotal movement together relative to said ram;

an additional connecting means for pivotally mounting an upper end of each of said pull links to a respective one of said additional lever links; and wherein said drive means is further operable to force said additional lever links to pivot relative to said ram in unison with said lever links upon operation of said cylinder device in said first and second selected manners.

13. A press apparatus as recited in claim 12, wherein said first connecting means comprises a connecting shaft mounted to and extending between upper ends of said pull links and mounted to and extending between said lever links; and said additional connecting means comprises an additional connecting shaft mounted to and extending between upper ends of said additional pull links and mounted to and extending between said additional lever links.

* * * * *